US008231481B2

(12) United States Patent
Takechi

(10) Patent No.: US 8,231,481 B2
(45) Date of Patent: Jul. 31, 2012

(54) GOLF CLUB HEAD

(75) Inventor: Takaharu Takechi, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 256 days.

(21) Appl. No.: 12/496,285

(22) Filed: Jul. 1, 2009

(65) Prior Publication Data

US 2010/0087271 A1 Apr. 8, 2010

(30) Foreign Application Priority Data

Oct. 7, 2008 (JP) ..... 2008-261007

(51) Int. Cl.
*A63B 53/04* (2006.01)

(52) U.S. Cl. ..... 473/342; 473/345

(58) Field of Classification Search ..... 473/324–350
See application file for complete search history.

(56) References Cited

U.S. PATENT DOCUMENTS

| | | | | |
|---|---|---|---|---|
| 4,214,754 | A * | 7/1980 | Zebelean | 473/346 |
| 4,432,549 | A * | 2/1984 | Zebelean | 473/346 |
| 5,028,049 | A * | 7/1991 | McKeighen | 473/345 |
| RE34,925 | E * | 5/1995 | McKeighen | 473/305 |
| 5,482,279 | A * | 1/1996 | Antonious | 473/327 |
| 6,248,025 | B1 * | 6/2001 | Murphy et al. | 473/324 |
| 6,254,494 | B1 * | 7/2001 | Hasebe et al. | 473/349 |
| 6,322,459 | B1 * | 11/2001 | Nishimura et al. | 473/330 |
| 6,435,981 | B2 * | 8/2002 | Naruo et al. | 473/329 |
| 6,565,452 | B2 * | 5/2003 | Helmstetter et al. | 473/342 |
| 6,783,465 | B2 | 8/2004 | Matsunaga | |
| 6,783,466 | B2 | 8/2004 | Seki et al. | |
| 6,949,031 | B2 | 9/2005 | Imamoto et al. | |
| 7,140,974 | B2 * | 11/2006 | Chao et al. | 473/329 |
| 7,278,925 | B2 * | 10/2007 | Oyama | 473/329 |
| 7,303,488 | B2 * | 12/2007 | Kakiuchi et al. | 473/346 |
| 7,316,624 | B2 * | 1/2008 | Sanchez | 473/345 |
| 7,377,861 | B2 * | 5/2008 | Tateno et al. | 473/345 |
| 7,396,293 | B2 | 7/2008 | Soracco | |
| 7,473,191 | B2 * | 1/2009 | Yokota | 473/345 |
| 7,575,525 | B2 * | 8/2009 | Matsunaga et al. | 473/342 |
| 7,658,687 | B2 * | 2/2010 | Hirano | 473/345 |
| 7,850,545 | B2 * | 12/2010 | Wada et al. | 473/332 |
| 2002/0091015 | A1 | 7/2002 | Seki et al. | |
| 2003/0114244 | A1 | 6/2003 | Matsunaga | |
| 2004/0204264 | A1 | 10/2004 | Matsunaga et al. | |
| 2005/0003904 | A1 | 1/2005 | Imamoto et al. | |
| 2008/0090676 | A1 | 4/2008 | Matsunaga et al. | |
| 2008/0153626 | A1 | 6/2008 | Matsunaga et al. | |

FOREIGN PATENT DOCUMENTS

| | | | |
|---|---|---|---|
| JP | 04020357 | A * | 1/1992 |
| JP | 06269518 | A * | 9/1994 |
| JP | 8-155060 | A | 6/1996 |
| JP | 08280853 | A * | 10/1996 |
| JP | 9-192273 | A | 7/1997 |
| JP | 10263118 | A * | 10/1998 |
| JP | 11146934 | A * | 6/1999 |

(Continued)

*Primary Examiner* — Alvin Hunter
(74) *Attorney, Agent, or Firm* — Sughrue Mion, PLLC

(57) ABSTRACT

A golf club head of this invention is a hollow golf club head which includes a face portion, a crown portion, a sole portion, and a side portion. The wall thickness of a face/crown bending portion, which is molded by casting and forms the boundary between the face portion and the crown portion, is smaller on the toe side than on the heel side.

10 Claims, 5 Drawing Sheets

FOREIGN PATENT DOCUMENTS

| | | | | |
|---|---|---|---|---|
| JP | 2000070417 | A | * | 3/2000 |
| JP | 2000126340 | A | * | 5/2000 |
| JP | 2002035178 | A | * | 2/2002 |
| JP | 2002058762 | A | * | 2/2002 |
| JP | 2003126307 | A | * | 5/2003 |
| JP | 2003275343 | A | * | 9/2003 |
| JP | 2004216132 | A | * | 8/2004 |
| JP | 2004313354 | A | * | 11/2004 |
| JP | 2007037921 | A | * | 2/2007 |
| JP | 2007111168 | A | * | 5/2007 |
| JP | 2007159984 | A | * | 6/2007 |
| JP | 2008136861 | A | * | 6/2008 |
| JP | 2010029379 | A | * | 2/2010 |
| JP | 2010088630 | A | * | 4/2010 |

* cited by examiner

GOLF CLUB HEAD

BACKGROUND OF THE INVENTION

1. Field of the Invention

The present invention relates to a hollow golf club head.

2. Description of the Related Art

There have been proposed wood type and utility type (hybrid type) golf club heads which have a hollow structure (e.g., Japanese Patent Laid-Open No. 8-155060). In the golf club heads of these types, distance performances are often regarded as important, and a more stable carry of a shot is desirable.

A carry of a shot has a relation to the golf ball hitting point on the face portion. Average golfers often hit a golf ball at various points, and therefore a carry of a shot also tends to vary. On the other hand, a variation in hitting point has a certain tendency.

SUMMARY OF THE INVENTION

It is an object of the present invention to provide a golf club head which can offer a more stable carry of a shot.

According to the present invention, there is provided a hollow golf club comprising a face portion, a crown portion, a sole portion, and a side portion, wherein a wall thickness of a face/crown bending portion, which is molded by casting and forms a boundary between said face portion and said crown portion, is smaller on a toe side than on a heel side.

According to the present invention, there is provided a hollow golf club head comprising a face portion, a crown portion, a sole portion, and a side portion, wherein a wall thickness of a face/sole bending portion, which is molded by casting and forms a boundary between said face portion and said sole portion, is smaller on a heel side than on a toe side.

According to the present invention, there is provided a hollow golf club head comprising a face portion, a crown portion, a sole portion, and a side portion, wherein a wall thickness of a face/crown bending portion, which is molded by casting and forms a boundary between said face portion and said crown portion, is smaller on a toe side than on a heel side, and a wall thickness of a face/sole bending portion, which is molded by casting and forms a boundary between said face portion and said sole portion, is smaller on the heel side than on the toe side.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
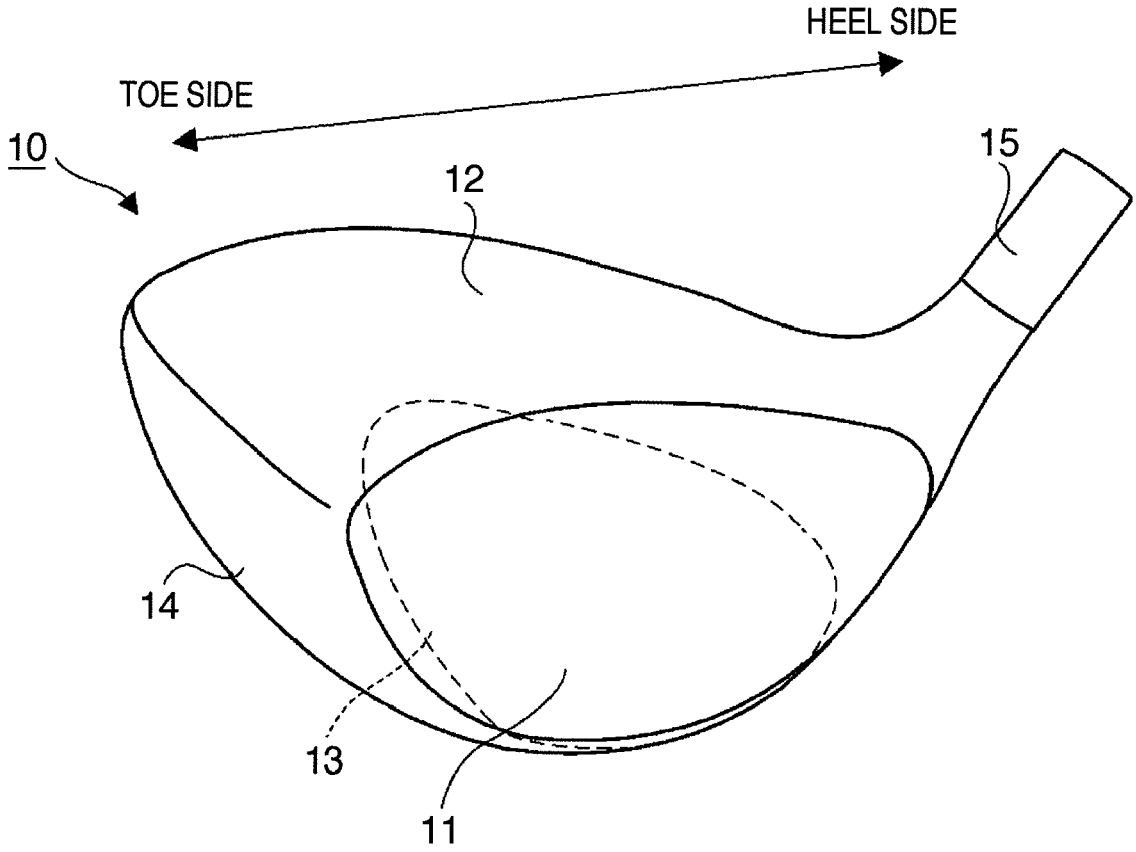
FIG. 1 is a perspective view of a golf club head 10 according to one embodiment of the present invention.
Figure 2A:
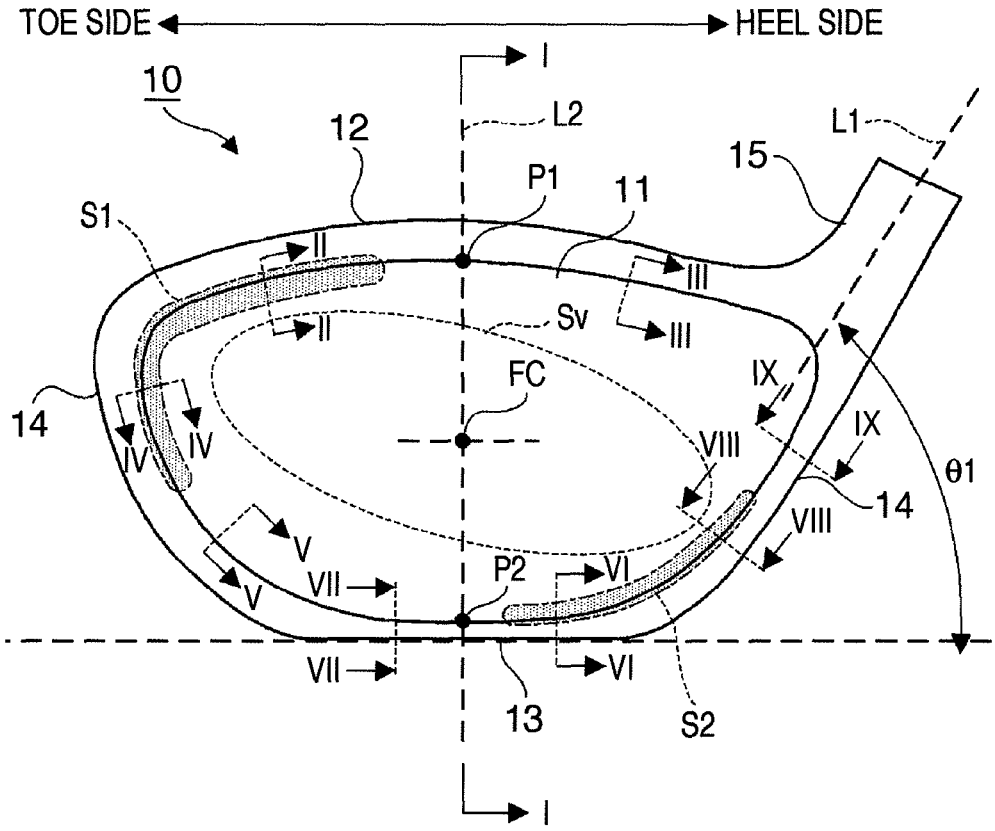
FIG. 2A is a front view of the golf club head 10 seen from a face portion 11 side.
Figure 2B:
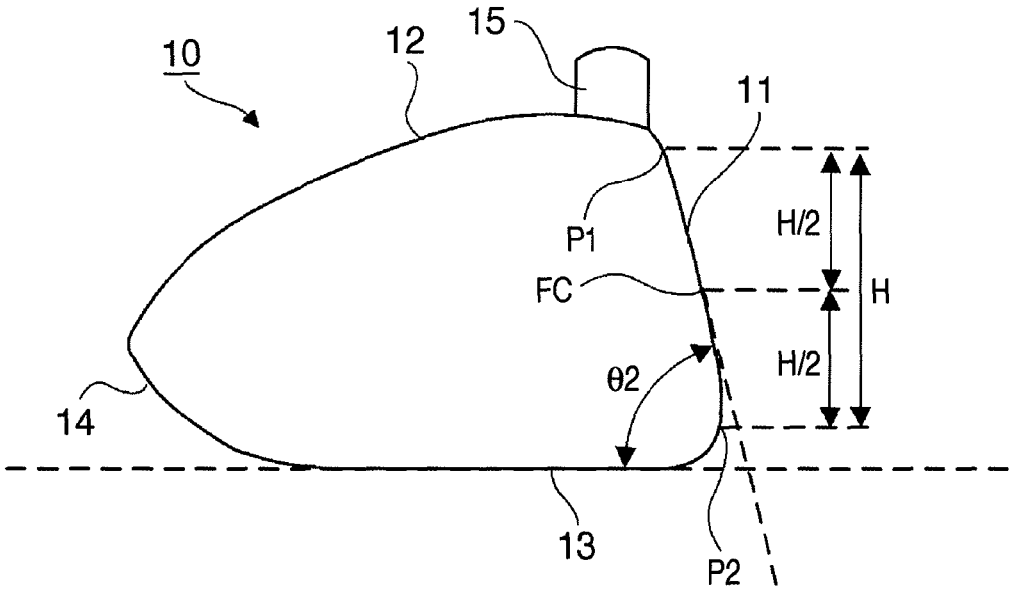
FIG. 2B is a side view of the golf club head 10.
Figure 3:
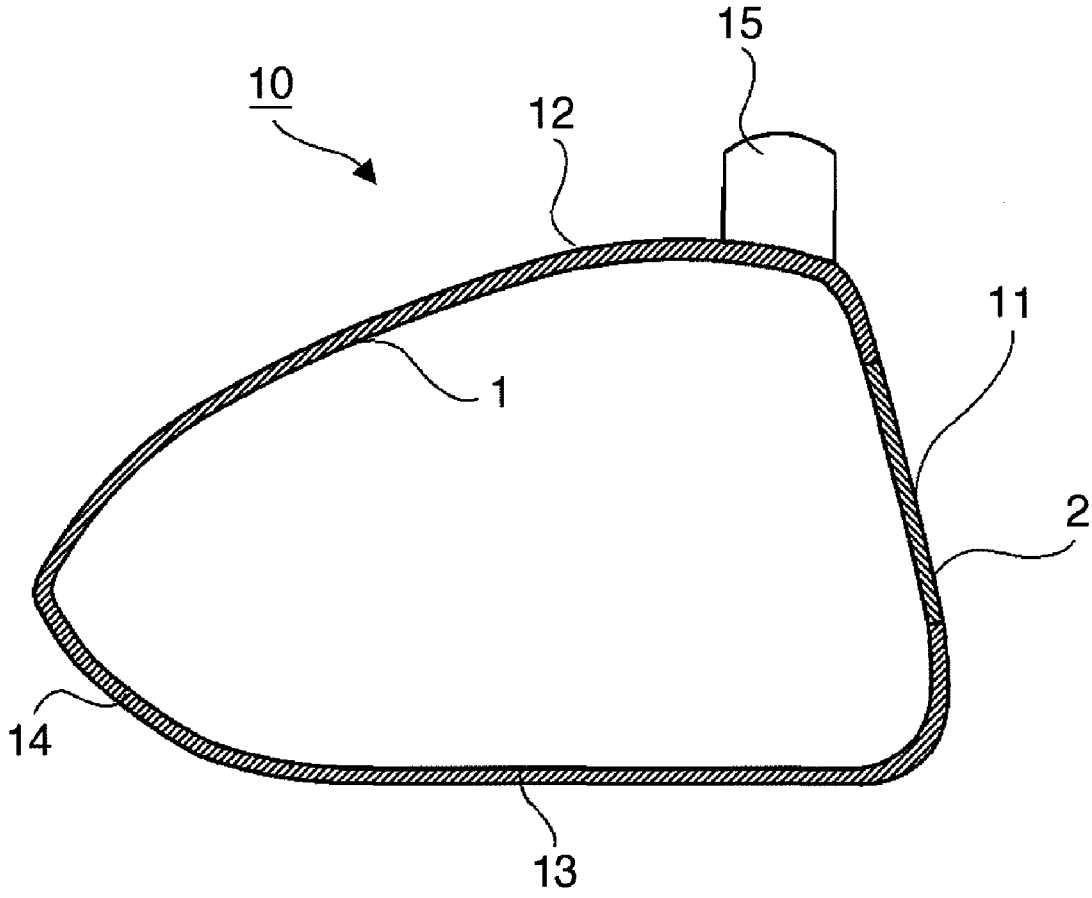
FIG. 3 is a sectional view taken along a line I-I in FIG. 2A.

FIG. 1 is a perspective view of a golf club head 10, and particularly of a sole portion 13 according to one embodiment of the present invention. FIG. 2A is a front view of the golf club head 10 seen from a face portion 11 side, and FIG. 2B is a side view of the golf club head 10. FIG. 3 is a sectional view taken along a line I-I in FIG. 2A.

The golf club head 10 is a hollow body, and its circumferential wall constitutes a face portion 11 forming the face (hitting surface), a crown portion 12 forming the top portion of the golf club head 10, the sole portion 13 forming the bottom portion of the golf club head 10, and a side portion 14 forming the side portion of the golf club head 10. The side portion 14 includes the toe-side, heel-side and back-side portions. A hosel portion 15 to which a shaft is to be attached is also provided in the golf club head 10.

Although the golf club head 10 is a golf club head for a driver, the present invention is applicable to wood type golf club heads including a fairway wood and the like other than a driver, utility type (hybrid type) golf club heads, and other hollow golf club heads.

The golf club head 10 can be made from a metal material. As such a metal material, a titanium metal (e.g., a titanium alloy of 6Al-4V-Ti and the like), stainless, and a copper alloy such as beryllium copper are available.

The golf club head 10 can be assembled by joining a plurality of parts. In this embodiment, the golf club head 10 is formed by joining a body member 1 and a face member 2, as shown in FIG. 3. The body member 1 constitutes the crown portion 12, the sole portion 13, the side portion 14, and the periphery portion of the face portion 11, and an opening portion is formed in a part of the portion corresponding to the face portion 11. The face member 2 is joined to the body member 1 so as to close this opening portion. The face portion 11 is formed from the periphery of the opening portion of the body member 1 and the face member 2. The body member 1 is molded by casting. Although the opening portion of the body member 1 is provided in a part of the portion corresponding to the face portion 11 in this embodiment, it may be provided in another portion such as a part of the portion corresponding to the sole portion 13 and a member to close the opening portion may be joined thereto.

Referring to FIG. 2A, the golf club head 10 has thin-walled regions S1 and S2 formed by decreasing the thicknesses in the region of a part of the bending portion on the periphery of the face portion 11 and that of a part of the periphery of the face portion 11. The thin-walled regions S1 and S2 are parts of the body member 1, and formed by casting upon casting the body member 1. The thin-walled region S1 is formed in the golf club head 10 from the crown portion 12 side to the toe-side side portion 14 side. In this embodiment, the thin-walled region S1 is located closer to the toe side than a virtual line L2 passing through a face center FC. The thin-walled region S2 is formed in the golf club head 10 from the sole portion 13 side to the heel-side side portion 14 side. In this embodiment, the thin-walled region S2 is located closer to the heel side than the virtual line L2 passing through the face center FC.

The face center FC will be described with reference to FIGS. 2A and 2B. In FIG. 2A, an angle θ1 represents a lie angle, which is an angle formed by the ground surface and an axis L1 of a shaft to be attached to the hosel portion 15. In FIG. 2B, an angle θ2 represents a loft angle, which is an angle formed by the face portion 11 and the ground surface. In FIG. 2A, the line L2 is a line which passes the center line in the toe-and-heel direction of the portion touching the ground surface, as shown in FIG. 2A, when the golf club head 10 touches the ground surface with its defined lie angle and loft angle. Positions P1 and P2 indicate the upper end and lower end, respectively, of the face portion 11 at which the face portion 11 intersects this line L2. The position at which a height difference H between the positions P1 and P2 is halved is defined as the face center FC.

Figure 4A:
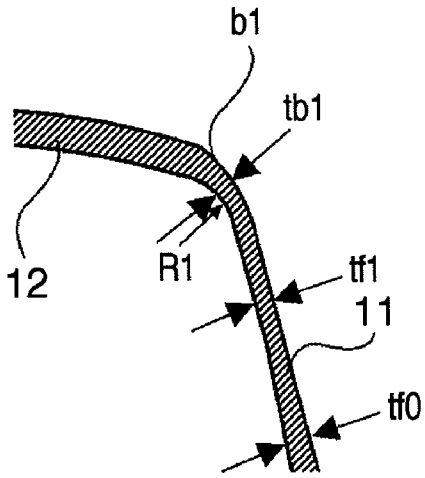
FIG. 4A is a sectional view taken along a line II-II in FIG. 2A.
Figure 4B:
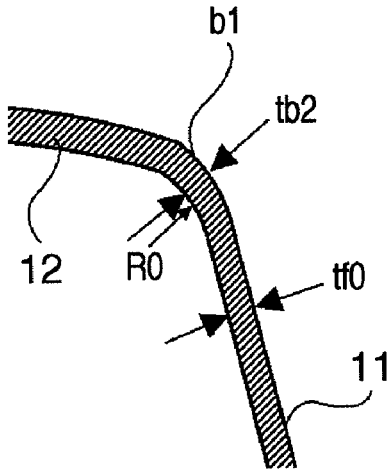
FIG. 4B is a sectional view taken along a line III-III in FIG. 2A.

FIG. 4A is a sectional view taken along a line II-II in FIG. 2A, and FIG. 4B is a sectional view taken along a line III-III in FIG. 2A. As shown in FIGS. 4A and 4B, a face/crown bending portion b1, which forms the boundary between the face portion 11 and crown portion 12, has a thickness tb1 in the thin-walled region S1 relatively on the toe side, that is smaller than a thickness tb2 (>tb1) of the bending portion b1 relatively on the heel side. In this embodiment, the thickness of the bending portion b1 is changed by changing the radius of its inner perimeter, which is a radius R1 in the thin-walled region S1 and a radius R0 (>R1) in the bending portion b1 relatively on the heel side.

Also in this embodiment, the face portion 11 has a thickness tf1 in the thin-walled region S1 relatively on the toe side, that is smaller than a thickness tf0 (>tf1) relatively on the heel side, and increases in thickness as it is separated from the bending portion b1, up to the thickness tf0.

It is also possible to employ a structure in which the face portion 11 is not decreased in thickness in the thin-walled region S1. In that case, however, the thickness sharply changes from the bending portion b1 to the face portion 11, and stress may concentrate thereon. Therefore, it is preferable that the thickness of the face portion 11 is decreased in the thin-walled region S1 and increases as the face portion 11 is separated from the bending portion b1, as in this embodiment.

Figure 4C:
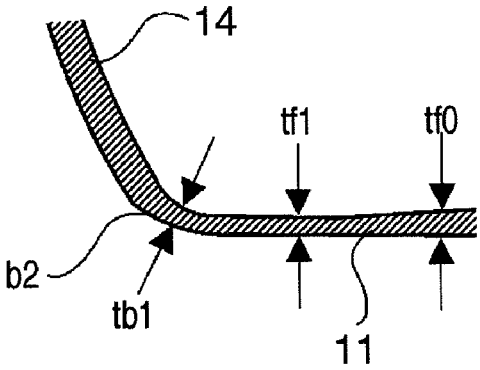
FIG. 4C is a sectional view taken along a line IV-IV in FIG. 2A.
Figure 4D:
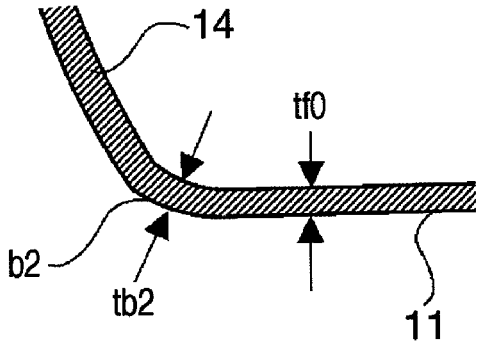
FIG. 4D is a sectional view taken along a line V-V in FIG. 2A.

FIG. 4C is a sectional view taken along a line IV-IV in FIG. 2A, and FIG. 4D is a sectional view taken along a line V-V in FIG. 2A. As shown in FIGS. 4C and 4D, a face/toe-side side bending portion b2, which forms the boundary between the face portion 11 and toe-side side portion 14, has the thickness tb1 in the thin-walled region S1 relatively on the crown portion 12 side, that is smaller than the thickness tb2 (>tb1) of the bending portion b2 relatively on the sole portion 13 side. In this embodiment, the thickness of the bending portion b2 is changed by changing the radius of its inner perimeter, as in the case shown in FIGS. 4A and 4B.

Also in this embodiment, the face portion 11 has the thickness tf1 in the thin-walled region S1 relatively on the crown portion 12 side, that is smaller than the thickness tf0 (>tf1) relatively on the sole portion 13 side, and increases in thickness as it is separated from the bending portion b2, up to the thickness tf0.

It is also possible to employ a structure in which the face portion 11 is not decreased in thickness in the thin-walled region S1. In that case, however, the thickness sharply changes from the bending portion b2 to the face portion 11, and stress may concentrate thereon. Therefore, it is preferable that the thickness of the face portion 11 is decreased in the thin-walled region S1 and increases as the face portion 11 is separated from the bending portion b2, as in this embodiment.

Figure 5A:
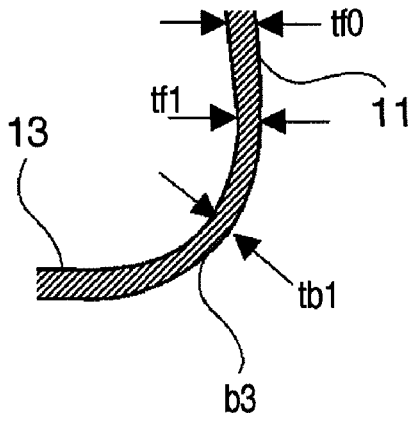
FIG. 5A is a sectional view taken along a line VI-VI in FIG. 2A.
Figure 5B:
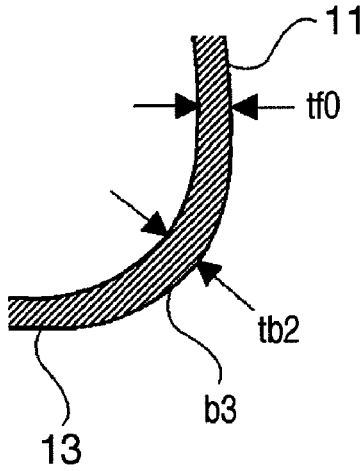
FIG. 5B is a sectional view taken along a line VII-VII in FIG. 2A.

The thin-walled region S2 has the same arrangement as the thin-walled region S1. FIG. 5A is a sectional view taken along a line VI-VI in FIG. 2A, and FIG. 5B is a sectional view taken along a line VII-VII in FIG. 2A. As shown in FIGS. 5A and 5B, a face/sole bending portion b3, which forms the boundary between the face portion 11 and sole portion 13, has the thickness tb1 in the thin-walled region S2 relatively on the heel side, that is smaller than the thickness tb2 (>tb1) of the bending portion b3 relatively on the toe side. In this embodiment, the thickness of the bending portion b3 is changed by changing the radius of its inner perimeter, as in the case shown in FIGS. 4A and 4B.

Also in this embodiment, the face portion 11 has the thickness tf1 in the thin-walled region S2 relatively on the heel side, that is smaller than the thickness tf0 (>tf1) relatively on the toe side, and increases in thickness as it is separated from the bending portion b3, up to the thickness tf0.

It is also possible to employ a structure in which the face portion 11 is not decreased in thickness in the thin-walled region S2. In that case, however, the thickness sharply changes from the bending portion b3 to the face portion 11, and stress may concentrate thereon. Therefore, it is preferable that the thickness of the face portion 11 is decreased in the thin-walled region S2 and increases as the face portion 11 is separated from the bending portion b3, as in this embodiment.

Figure 5C:
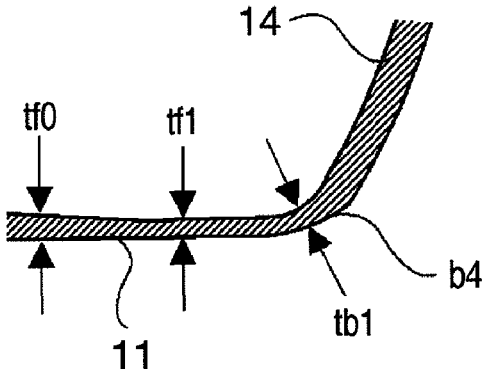
FIG. 5C is a sectional view taken along a line VIII-VIII in FIG. 2A.
Figure 5D:
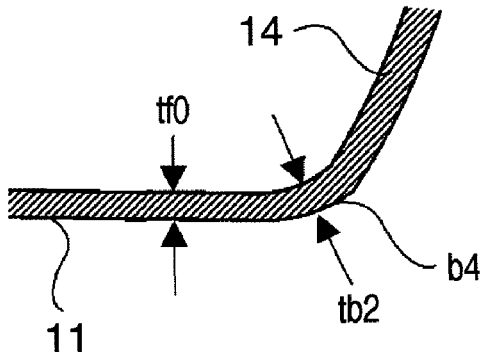
FIG. 5D is a sectional view taken along a line IX-IX in FIG. 2A.

FIG. 5C is a sectional view taken along a line VIII-VIII in FIG. 2A, and FIG. 5D is a sectional view taken along a line IX-IX in FIG. 2A. As shown in FIGS. 5C and 5D, a face/heel-side side bending portion b4, which forms the boundary between the face portion 11 and heel-side side portion 14, has the thickness tb1 in the thin-walled region S2 relatively on the sole portion 13 side, that is smaller than the thickness tb2 (>tb1) of the bending portion b4 relatively on the crown portion 12 side. In this embodiment, the thickness of the bending portion b4 is changed by changing the radius of its inner perimeter, as in the case shown in FIGS. 4A and 4B.

Also in this embodiment, the face portion 11 has the thickness tf1 in the thin-walled region S2 relatively on the sole portion 13 side, that is smaller than the thickness tf0 (>tf1) relatively on the crown portion 12 side, and increases in thickness as it is separated from the bending portion b4, up to the thickness tf0.

It is also possible to employ a structure in which the face portion 11 is not decreased in thickness in the thin-walled region S2. In that case, however, the thickness sharply changes from the bending portion b4 to the face portion 11, and stress may concentrate thereon. Therefore, it is preferable that the thickness of the face portion 11 is decreased in the thin-walled region S2 and increases as the face portion 11 is separated from the bending portion b4, as in this embodiment.

For example, when the golf club head 10 is made from a titanium alloy, the thicknesses tb1, tb2, tf1 and tf0 described above can be set such that the thicknesses tb1 and tf1 are 2.0 mm to 2.5 mm, and the thicknesses tb2 and tf0 are 2.3 mm to 3.5 mm.

In the golf club head 10 of this embodiment having the above-described structure, the bending portions b1 to b4 are decreased in thickness in the thin-walled regions S1 and S2. Accordingly, in the periphery portion of the face portion 11, the region on the crown portion 12 side on the toe side and that on the sole portion 13 side on the heel side more easily bend than the other regions. In addition, since the face portion 11 itself is decreased in thickness in the thin-walled regions S1 and S2, in the periphery portion of the face portion 11, the region on the crown portion 12 side on the toe side and that on the sole portion 13 side on the heel side further easily bend.

On the other hand, according to research by the inventor of the present invention, average golfers tend to hit a ball at the face portion 11 on the crown portion 12 side on the toe side and that on the sole portion 13 side on the heel side. This shows a distribution represented by a region Sv in FIG. 2A. In this embodiment, the regions of the face portion 11 on the crown portion 12 side on the toe side and that on the sole portion 13 side on the heel side more easily bend. Therefore, when the hitting point falls outside the vicinity of the face center FC but within the region on the crown portion 12 side on the toe side or that on the sole portion 13 side on the heel side, a carry of a shot does not largely decrease, and a more stable carry of a shot can be obtained. In addition, since the portions of the periphery of the face portion 11 other than the thin-walled regions S1 and S2 are relatively thick, the strength can be ensured.

Since the thin-walled regions S1 and S2 are molded by casting, it is relatively easy to form them. In addition, because the body member 1 includes the periphery portion of the face portion 11 including the thin-walled regions S1 and S2, when the face member 2 is joined by welding, it is possible to form the thin-walled regions S1 and S2 more securely without being influenced by a change in wall thickness by welding.

Note that the thin-walled regions S1 and S2 are formed in this embodiment, but only one of them may be formed. When only the thin-walled region S1 is formed, even if the hitting point falls outside the vicinity of the face center FC but within the region on the crown portion 12 side on the toe side, a carry of the shot does not largely decrease. Accordingly, a golfer who often hits a ball at a region on the crown portion 12 side on the toe side can obtain a more stable carry of a shot. When only the thin-walled region S2 is formed, even if the hitting point falls not within the vicinity of the face center FC but within the region on the sole portion 13 side on the heel side, a carry of the shot does not largely decrease. Accordingly, a golfer who often hits a ball at a region on the sole portion 13 side on the heel side can obtain a more stable carry of a shot.

The thin-walled region S1 is formed from the crown portion 12 side to the side portion 14 side on the toe side in this embodiment, but it may be formed only on the crown portion 12 side. This case also has a certain effect of suppressing a decrease in carry of a shot when the hitting point falls outside the vicinity of the face center FC but within the region on the crown portion 12 side on the toe side. However, it is more preferable that the thin-walled region S1 is formed on the side portion 14 side as well, as in this embodiment.

Likewise, the thin-walled region S2 is formed from the sole portion 13 side to the side portion 14 side on the heel side in this embodiment, but it may be formed only on the sole portion 13 side. This case also has a certain effect of suppressing a decrease in carry of a shot when the hitting point falls not within the vicinity of the face center FC but within the region on the sole portion 13 side on the heel side. However, it is more preferable that the thin-walled region S2 is formed on the side portion 14 side as well, as in this embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-261007, filed Oct. 7, 2008, which is hereby incorporated by reference herein in its entirety.

What is claimed is:

1. A hollow golf club comprising a face portion, a crown portion, a sole portion, and a side portion, wherein a face/crown bending portion, which is molded by casting and forms a boundary between said face portion and said crown portion, includes:

a heel side region; and a thin wall region on a toe side along the boundary, a wall thickness of the thin wall region being smaller than a wall thickness of the heel side region and a wall thickness of a surrounding portion that is adjacent the boundary toward the sole portion on the toe side.

2. A hollow golf club head comprising a face portion, a crown portion, a sole portion, and a side portion, wherein a face/sole bending portion, which is molded by casting and forms a boundary between said face portion and said sole portion, includes:

a toe side region; and a thin wall region on a heel side along the boundary, a wall thickness of the thin wall region being smaller than a wall thickness of the toe side region and a wall thickness of a surrounding portion that is adjacent the boundary toward the crown portion on the heel side.

3. A hollow golf club comprising a face portion, a crown portion, a sole portion, and a side portion, wherein a wall thickness of a face/crown bending portion, which is molded by casting and forms a boundary between said face portion and said crown portion, is smaller on a toe side than on a heel side, and wherein a wall thickness of a face/toe-side side bending portion, which is molded by casting and forms a boundary between said face portion and said side portion on the toe side, is smaller on said crown portion side than on said sole portion side.

4. The head according to claim 3, wherein in said face portion, a wall thickness in a region on said crown portion side on the toe side is smaller than a wall thickness in a region on said crown portion side on the heel side and a wall thickness in a region on said sole portion side on the toe side.

5. A hollow golf club head comprising a face portion, a crown portion, a sole portion, and a side portion, wherein a wall thickness of a face/sole bending portion, which is molded by casting and forms a boundary between said face portion and said sole portion, is smaller on a heel side than on a toe side, and wherein a wall thickness of a face/heel-side side bending portion, which is molded by casting and forms a boundary between said face portion and said side portion on the heel side, is smaller on said sole portion side than on said crown portion side.

6. The head according to claim 5, wherein in said face portion, a wall thickness in a region on said sole portion side on the heel side is smaller than a wall thickness in a region on said sole portion side on the toe side and a wall thickness in a region on said crown portion side on the heel side.

7. A hollow golf club head comprising a face portion, a crown portion, a sole portion, and a side portion, wherein a face/crown bending portion, which is molded by casting and forms a face/crown boundary between said face portion and said crown portion, includes:

a heel side region; and a first thin wall region on a toe side along the face/crown boundary, a wall thickness of the first thin wall region being smaller than a wall thickness of the heel side region and a wall thickness of its surrounding portion, and a face/sole bending portion, which is molded by casting and forms a face/sole boundary between said face portion and said sole portion, includes:

a toe side region; and a second thin wall region on a heel side along the face/sole boundary, a wall thickness of the second thin wall region being smaller than a wall thickness of the toe side region and a wall thickness of its surrounding portion.

8. A hollow golf club head comprising a face portion, a crown portion, a sole portion, and a side portion, wherein a wall thickness of a face/crown bending portion, which is molded by casting and forms a boundary between said face portion and said crown portion, is smaller on a toe side than on a heel side, a wall thickness of a face/sole bending portion, which is molded by casting and forms a boundary between said face portion and said sole portion, is smaller on the heel side than on the toe side, a wall thickness of a face/toe-side side bending portion, which is molded by casting and forms a boundary between said face portion and said side portion on the toe side, is smaller on said crown portion side than on said sole portion side, and a wall thickness of a face/heel-side side bending portion, which is molded by casting and forms a boundary between said face portion and said side portion on the heel side, is smaller on said sole portion side than on said crown portion side.

9. The head according to claim 8, wherein in said face portion, a wall thickness in a region of on said crown portion side on the heel side is smaller than a wall thickness in a region on said crown portion side on the heel side and a wall thickness in a region on said sole portion side on the toe side, and in said face portion, a wall thickness in a region on said sole portion side on the toe side is smaller than a wall thickness in a region on said sole portion side on the toe side and a wall thickness in a region on said crown portion side on the heel side.

10. A hollow golf club head comprising a face portion, a crown portion, a sole portion, and a side portion, wherein a wall thickness of a face/crown bending portion, which is molded by casting and forms a boundary between said face portion and said crown portion, is smaller on a toe side than on a heel side, a wall thickness of a face/sole bending portion, which is molded by casting and forms a boundary between said face portion and said sole portion, is smaller on the heel side than on the toe side, and wherein the golf club head is formed by joining a body member which forms said crown portion, said sole portion, said side portion, and a periphery portion of said face portion, and a face member which forms the other portion of said face portion, and said body member is made by casting.

* * * * *